US007533601B2

(12) United States Patent
Lapp et al.

(10) Patent No.: US 7,533,601 B2
(45) Date of Patent: May 19, 2009

(54) MULTI-PART PISTON FOR A COMBUSTION ENGINE

(75) Inventors: Michael T. Lapp, Bloomfield, MI (US); Dan Dinu, Windsor (CA)

(73) Assignees: MAHLE Technology, Inc., Farmington Hills, MI (US); MAHLE International GmbH, Stuttgart (DE)

( * ) Notice: Subject to any disclaimer, the term of this patent is extended or adjusted under 35 U.S.C. 154(b) by 258 days.

(21) Appl. No.: 11/637,521

(22) Filed: Dec. 12, 2006

(65) Prior Publication Data

US 2008/0134880 A1 Jun. 12, 2008

(51) Int. Cl.
*F01B 31/08* (2006.01)

(52) U.S. Cl. ..... 92/186

(58) Field of Classification Search ..... 92/186, 92/231

See application file for complete search history.

(56) References Cited

U.S. PATENT DOCUMENTS

| | | | | |
|---|---|---|---|---|
| 5,081,968 | A * | 1/1992 | Bruni | 92/186 |
| 6,729,291 | B1 | 5/2004 | Scharp et al. | |
| 2003/0167918 | A1 | 9/2003 | Kemnitz et al. | |

FOREIGN PATENT DOCUMENTS

| | | | |
|---|---|---|---|
| DE | 102 57 022 | A1 | 6/2004 |
| EP | 1 483 493 | B1 | 9/2003 |

* cited by examiner

*Primary Examiner*—F. Daniel Lopez
(74) *Attorney, Agent, or Firm*—Collard & Roe, P.C.

(57) ABSTRACT

A multi-part piston for a combustion engine having a piston upper part and a piston lower part, where the piston upper part has a piston crown and an attachment head on its side facing the piston lower part, and the piston lower part has an attachment element in which the attachment head is held, the attachment element being disposed on a side facing the piston upper part. The attachment head is held in the attachment element by a press fit.

11 Claims, 3 Drawing Sheets

MULTI-PART PISTON FOR A COMBUSTION ENGINE

BACKGROUND OF THE INVENTION

1. Field of the Invention

The present invention relates to a multi-part piston for a combustion engine having a piston upper part and a piston lower part. The upper part has an attachment head on its side facing the lower part. The lower part has a support plate with a plate element and an attachment element holding the attachment head, located on a side of the lower part facing the upper part.

2. The Prior Art

Multi-part pistons have the crucial advantage that the piston upper part and the piston lower part can be of different materials. The piston upper part is generally made from a particularly wear-resistant and heat-resistant, but relatively heavy material, while the piston lower part is generally made from a less wear-resistant light metal material in order to reduce its weight. Here, the piston upper part and the piston lower part can be connected to one another by screwing, as disclosed for example in European Patent No. EP 1 483 493 B1.

A generic piston is described in German Patent No. DE 102 57 022 A1. It has a threaded head attached to the piston upper part and a support plate attached to the piston lower part, and has a threaded element matching the threaded head, which are screwed to one another during assembly of the piston.

In diesel engines in particular, pistons are subject to high thermal and mechanical stresses. It is therefore desirable to provide the piston with a good cooling system, i.e. with a cooling channel of the largest possible volume, and with a connection between the piston lower part and the piston upper part that can withstand particularly high mechanical loads. At the same time, the piston should be lightweight and compact. In particular, the compression height should not be too great, in order to keep the cylinder block of a diesel engine in particular as low as possible.

SUMMARY OF THE INVENTION

It is therefore an object of the present invention to provide a piston of this type where the piston upper part and the piston lower part are firmly connected to one another, with the connection not being impaired if possible.

The invention comprises a piston for a combustion engine having a piston upper part and a piston lower part. The piston upper part has a piston crown and an attachment head on its side facing the piston lower part. The piston lower part has an attachment element in which the attachment head is held, located on a side of the lower part facing the piston upper part.

At least the attachment head is held in the attachment element by means of a press fit, so the bolted connection between piston upper part and piston lower part can be eliminated. The piston upper part can therefore be designed with a lower height and thickness. The stable connection between the piston upper part and the piston lower part is assured by a press fit that withstands even the increased loads in a diesel engine. Since the piston upper part is designed considerably less solid than previously, the weight of the piston according to the invention is reduced. In addition, the surface and the volume of the cooling channel can be considerably greater than before, so that the cooling of the piston is considerably improved. Due to the lower design height of the piston upper part, the compression height of the piston according to the invention is reduced, so that the cylinder block of the associated combustion engine can be correspondingly reduced in height. The piston can be manufactured more economically and at lower cost overall.

In one embodiment, the piston upper part has an annular and all-round side wall, and the piston lower part has an axially aligned annular collar facing the piston upper part. The side wall grips around the annular collar. This embodiment has, in addition to the advantages already set forth, the additional advantage that the ring belt of the piston upper part is additionally supported by the collar. As a result, the ring belt is additionally stabilized against the loads occurring during engine operation. In particular, both the deformation of the annular grooves and the deformation of the ring belt are considerably reduced overall.

If an additional strengthening of the connection between the piston upper part and the piston lower part is required, the side wall can be held on the collar by means of a press fit. The piston upper part can be provided with a recess facing the piston lower part, and the piston lower part can be provided with a raised area facing the piston upper part. During assembly of the piston upper part and piston lower part, the recess and the raised area engage and are likewise held by a press fit. It is of course possible for the collar to also extend in the axial direction parallel to the side wall to underneath the piston crown.

The press fit between the piston upper part and the piston lower part is achieved either by simple pressing of the attachment head into the attachment element or of the side wall onto the collar. Alternatively, the attachment element of the piston upper part or the side wall of the piston upper part can be heated so that they expand. During cooling, the material contracts, so that the attachment element is shrunk onto the piston head or the side wall onto the collar. The piston upper part and the piston lower part can of course be additionally connected to one another by welding, soldering, bonding or the like.

The attachment element can have either a through-hole or a blind hole. If a hole extending entirely through the element is provided, the attachment element can have as an additional securing means a chamfer at its end facing the piston lower part, and the attachment head can grip the chamfer with its end facing the piston lower part. In the simplest case, it is possible for the attachment head and the attachment element to be riveted to one another.

In another embodiment, the piston lower part has an internal and all-round support element, and a support plate on which the fastening element is held is connected to the internal support element. In this way, the piston can have both an external and an internal all-round cooling channel.

If required, the piston upper part can have at least one all-around contact surface facing the piston lower part, and the piston lower part can have at least one all-around support surface corresponding to the contact surface and facing the piston upper part, so that the piston upper part is supported on the piston lower part after assembly.

The piston upper part and the piston lower part can be manufactured from different materials depending on the requirements of the particular application. The piston lower part can for example be made from a light metal material or from a steel material, and the piston upper part from a steel material which is particularly thermally stable.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
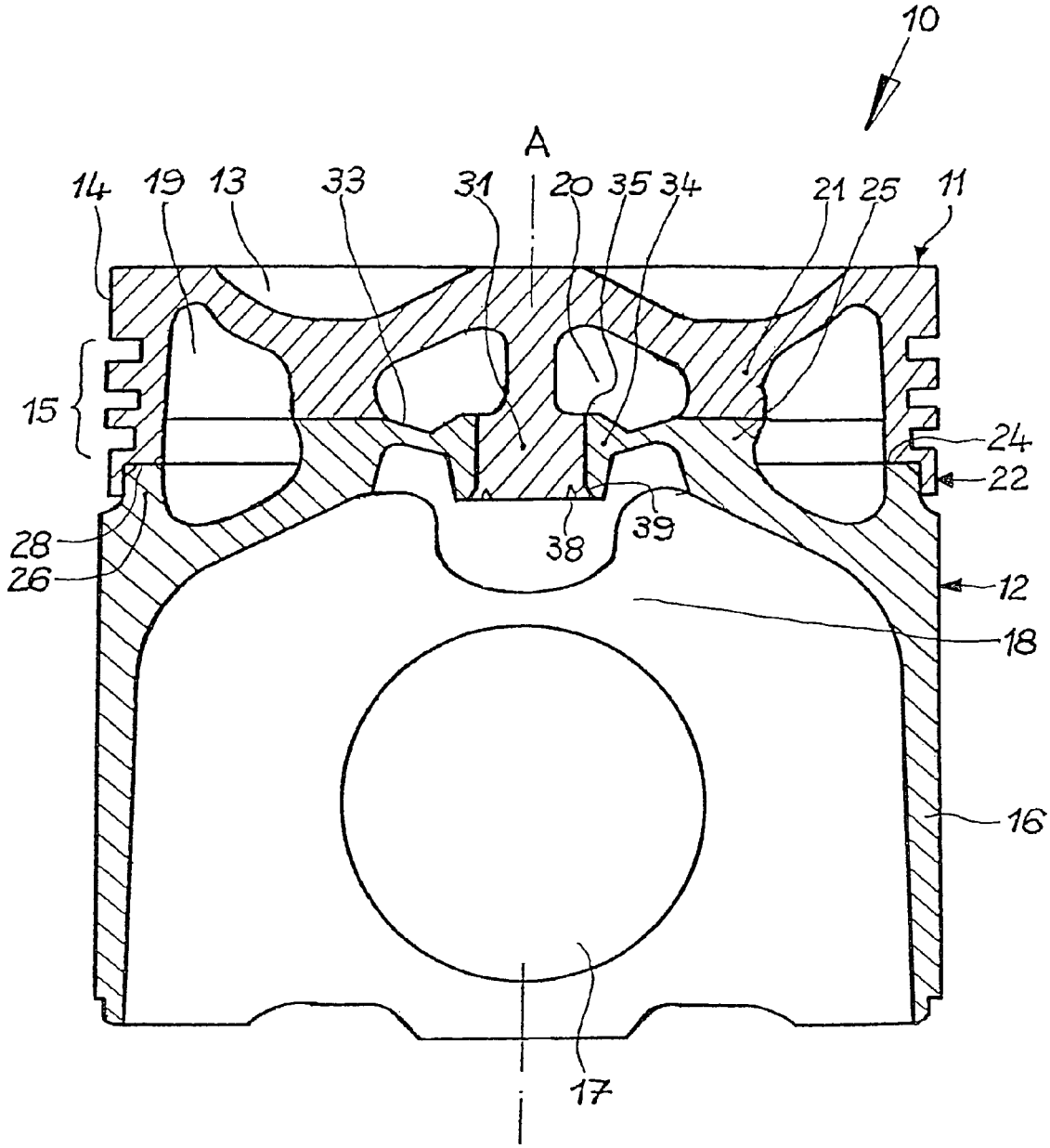
FIG. 1 shows a section through an embodiment of a piston according to the invention.
Figure 2:
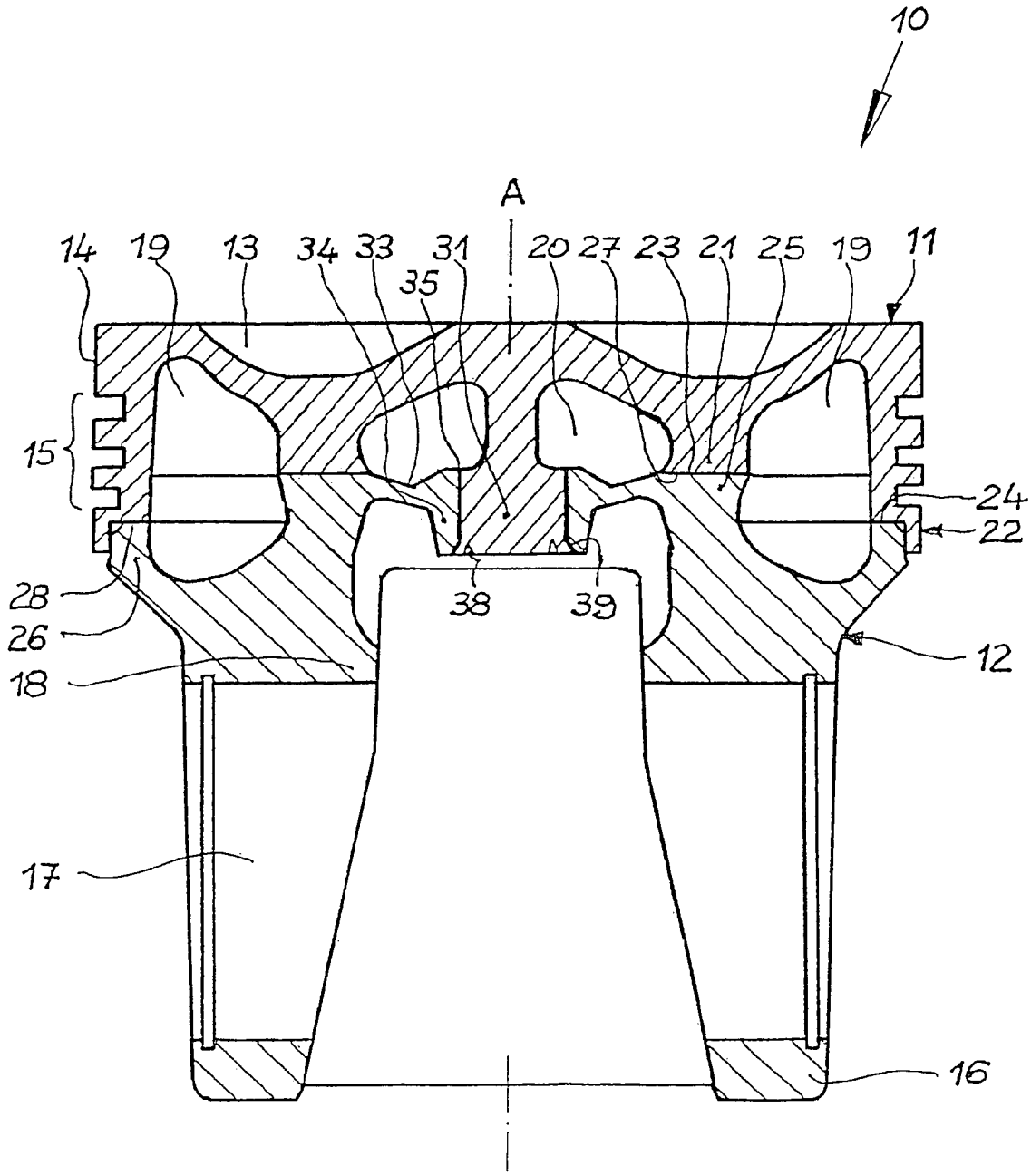
FIG. 2 shows a section through the embodiment of a piston according to the invention as per FIG. 1, rotated 90° about the longitudinal piston axis A.

Referring now in detail to the drawings and, in particular, FIGS. 1 and 2 show a section through an embodiment of a piston 10 according to the invention, where the illustration in FIG. 2 is rotated by 90° relative to the illustration in FIG. 1.

Piston 10 is composed of a piston upper part 11 and a piston lower part 12. Piston upper part 11 has a combustion bowl 13 and a side wall 14 with an all-around top land and an all-around ring belt 15. Piston upper part 12 has a piston skirt 16, pin bosses 17 for receiving the piston pin (not shown) and pin boss supports 18 connected to piston skirt 16. Piston upper part 11 and piston lower part 12 form an all-around external cooling channel 19 and an all-around internal cooling channel 20.

Piston upper part 11 has an all-around internal support element 21 with an all-around internal contact surface 23. Piston upper part 12 also has an all-around internal support element 25 with an all-around internal contact surface 27. Piston lower part 12 furthermore has an all-around annular collar 26 with an all-around contact surface 28. Corresponding to this, side wall 14 of piston upper part 11 is provided with an all-around collar 22 with an all-around contact surface 24.

In the assembled state, collar 22 of side wall 14 encloses annular collar 26 of piston upper part 12, where contact surfaces 24 and 28 come to rest on one another and side wall 14 is supported on collar 26. Side wall 14 and collar 26 are dimensioned so that a press fit of side wall 14 on collar 26 is constituted. Furthermore, piston upper part 11 and piston lower part 12 are aligned with one another so that internal contact surface 23 of internal support element 21 of piston upper part 11 and internal contact surface 27 of internal support element 25 of piston lower part 12 lie one on top of the other. Piston upper part 11 is thus supported on piston lower part 12 in this area.

Side wall 14 and internal support element 21 of piston upper part 11, and the collar 26 and internal support element 25 of piston lower part 12, form and limit all-around external cooling channel 19 of piston 10. Due to the slender design of piston upper part 11, cooling channel 19 has a particularly large volume and extends from the underside of combustion bowl 13 to piston skirt 12.

In the embodiment, an attachment head 31 is molded centrally in longitudinal piston axis A on the underside of piston upper part 11. Piston lower part 12 has a support plate 33 on its upper side facing piston upper part 11. Support plate 33 is connected to the inside of internal support element 25 of piston lower part 12 and has an attachment element 34 arranged centrally to the longitudinal piston axis A and having a hole 35 all through. Attachment head 31 is held in hole 35 of attachment element 34 by means of a press fit, so that piston upper part 11 and piston lower part 12 are firmly connected to one another, where they support one another on their contact surfaces 23 and 27, and 24 and 28 respectively.

For assembly, at least attachment element 34 and if necessary side wall 14 are heated. Then piston upper part 11 is mounted on piston lower part 12 and attachment head 31 is lowered into hole 35 of attachment element 34. When it cools, attachment element 34 or side wall 14 contracts, forming the press fit as described.

Attachment element 34 has a chamfer 39 as a supplementary securing device at its end facing piston upper part 12. Attachment head 31 grips the chamfer with its end facing piston lower part 12 to prevent attachment head 31 from coming loose under load. This embodiment can be achieved simply by riveting attachment head 31 inside attachment element 34. An all-round notch 38 can result from riveting.

Figure 3:
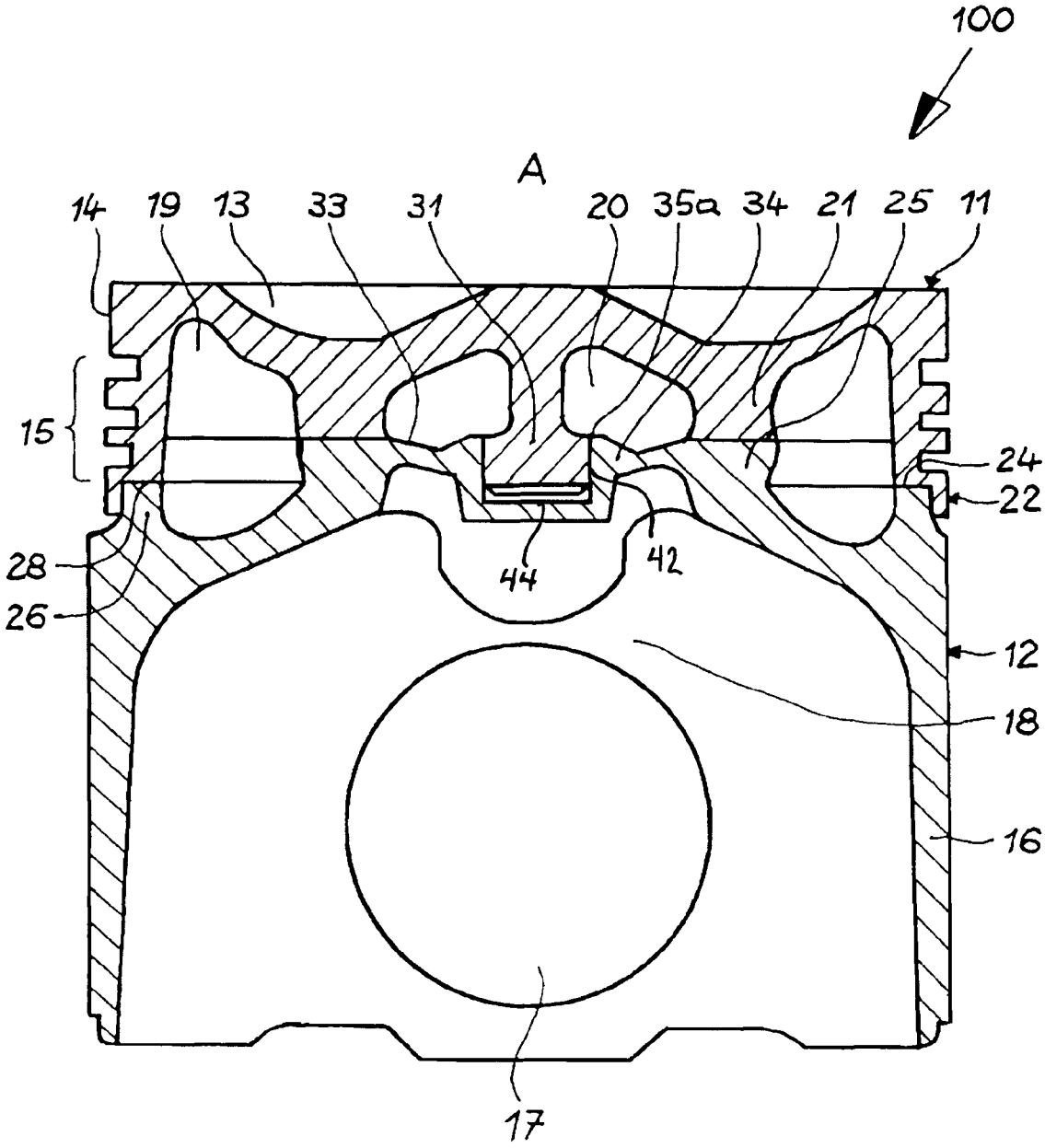
FIG. 3 shows a section through an alternative embodiment of a piston according to the invention.

An alternative embodiment is shown in FIG. 3 in which the hole that receives attachment head 31 is a blind hole 42, so that attachment head 31 is disposed adjacent a bottom end 44 of hole 42.

In addition to the press fit of attachment head 31 or side wall 14, piston upper part 11 can be secured to piston lower part 12 by welding, soldering, bonding and the like.

Internal support elements 21 and 25, support plate 33 and attachment head 31 form and limit the all-round internal cooling channel 20.

The coolant is, as is usual and familiar to the person skilled in the art, supplied from the outside to all-around external cooling channel 19. The coolant is conveyed from all-around external cooling channel 19 to all-around internal cooling channel 20 via transfer channels (not shown) and removed from there via drainage openings (not shown).

Accordingly, while only a few embodiments of the present invention have been shown and described, it is obvious that many changes and modifications may be made thereunto without departing from the spirit and scope of the invention.

What is claimed is:

1. A multi-part piston for a combustion engine, comprising:

a piston upper part having an piston crown;

a piston lower part;

an attachment head on the piston upper part, said attachment head being disposed on a side facing the piston lower part; and an attachment element on the piston lower part, said attachment element holding the attachment head and being located on a side of the piston lower part facing the piston upper part;

wherein the attachment head is held in the attachment element by means of a press fit;

wherein the piston lower part is provided with an axially aligned annular collar facing the piston upper part, and wherein the piston upper part has an annular and all-round side wall that grips around the annular collar and is held by a press fit.

2. A piston according to claim 1, wherein the piston upper part and the piston lower part are additionally connected to one another by welding, soldering, or bonding.

3. A piston according to claim 1, wherein the attachment element has a hole extending entirely therethrough.

4. A piston according to claim 3, wherein the attachment element has a chamfer at an end facing the piston lower part and the attachment head grips the chamfer with an end facing the piston lower part.

5. A piston according to claim 4, wherein the attachment head is riveted to the attachment element.

6. A piston according to claim 1, wherein the attachment element has a blind hole.

7. A piston according to claim 1, wherein the piston lower part has an internal and all-around support element, and wherein a support plate on which the attachment element is held is connected to the internal support element.

8. A piston according to claim 7, wherein the internal support element has an all-around support surface facing the piston upper part and the piston upper part has an all-around contact surface corresponding to the support surface and facing the piston lower part.

9. A piston according to claim 1, wherein the piston upper part and the piston lower part enclose an all-around cooling channel.

10. A piston according to claim 1, wherein the piston lower part comprises a lightweight metal or a steel material and the piston upper part comprises a steel material.

11. A multi-part piston for a combustion engine, comprising:

a piston upper part having an piston crown;

a piston lower part;

an attachment head on the piston upper part, said attachment head being disposed on a side facing the piston lower part; and an attachment element on the piston lower part, said attachment element holding the attachment head and being located on a side of the piston lower part facing the piston upper part;

wherein the attachment head is held in the attachment element by means of a press fit, and wherein the attachment element has a blind hole.

* * * * *